US005091675A

United States Patent [19]

Duenisch

[11] Patent Number: 5,091,675

[45] Date of Patent: Feb. 25, 1992

[54] FLASHBULB HAVING HARD GLASS CONTAINING EMITTER SUBSTANCES

[75] Inventor: Ingo Duenisch, Taunusstein, Fed. Rep. of Germany

[73] Assignee: Heimann GmbH, Fed. Rep. of Germany

[21] Appl. No.: 497,926

[22] Filed: Mar. 23, 1990

[30] Foreign Application Priority Data

Apr. 14, 1989 [EP] European Pat. Off. ..... 89106660.7

[51] Int. Cl.[5] ..... H01J 17/16

[52] U.S. Cl. ..... 313/636; 313/623

[58] Field of Search ..... 313/623, 636

[56] References Cited

U.S. PATENT DOCUMENTS

| | | | |
|---|---|---|---|
| 3,525,896 | 8/1970 | Soule et al. | 313/636 |
| 3,711,787 | 1/1973 | Snitzer et al. | 501/41 |
| 3,714,059 | 1/1973 | Shaw et al. | 501/64 |
| 3,997,250 | 12/1976 | Krohn et al. | 501/64 |
| 4,042,405 | 8/1977 | Krohn et al. | 501/63 |
| 4,097,774 | 6/1978 | Cosco et al. | 313/353 |
| 4,783,612 | 11/1988 | Sprengers | 313/636 |
| 4,944,784 | 7/1990 | Kohli et al. | 501/13 |

FOREIGN PATENT DOCUMENTS

| | | | |
|---|---|---|---|
| 0263379 | 9/1987 | European Pat. Off. . | |
| 0013842 | 4/1979 | Japan | 313/636 |
| 62-206761 | 9/1987 | Japan . | |

*Primary Examiner*—Donald J. Yusko
*Assistant Examiner*—N. D. Patel
*Attorney, Agent, or Firm*—Hill, Van Santen, Steadman & Simpson

[57] ABSTRACT

A flashbulb having an increased energy density. The composition of the hard glass of the flashbulb is selected such that the components thereof that volatilize easily during a discharge of the flashbulb are at least partially emitter substances that reduce the work function at the cathode member.

17 Claims, 1 Drawing Sheet

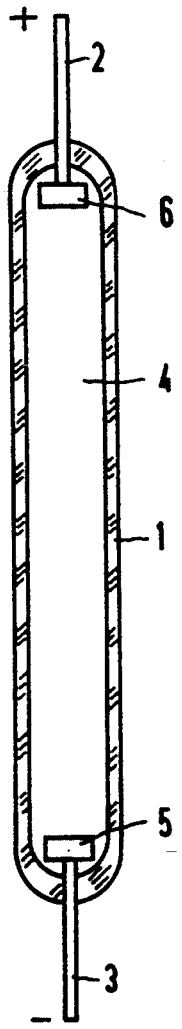
+
2
6
4
1
5
3
−

FLASHBULB HAVING HARD GLASS CONTAINING EMITTER SUBSTANCES

BACKGROUND OF THE INVENTION

The present invention is directed to a flashbulb having two electrodes fused in gas-tight manner into a glass bulb of hard glass.

As the photographic market evolves flashbulbs are required to have shorter and shorter times for burning and a smaller inside diameter in order to make cameras and flash attachments handier without decreasing the light power and the life span of the flashbulb. Materials previously used for rod-shaped flashbulbs, namely, hard glass for the glass bulb with a cathode of refractory metals having a barium or cesium emitter, place a limit on the energy density. This limit is defined by the following conditions:

the glass wall evaporates in a Xenon arc;

the emitter substances on the cathode surface evaporate; and the oxidic vapors of the glass wall "poison" the cathode.

Basically, the evaporation processes cannot be prevented since the hot 7000 K. degree plasma of the arc evaporates all solid bodies.

SUMMARY OF THE INVENTION

An object of the present invention is to provide a flashbulb whose loadability is enhanced over the prior art flashbulbs, i.e., the novel flashbulb of the present invention has a higher energy density when compared to known flashbulbs.

This object is inventively achieved in that the composition of the hard glass is selected such that the components thereof evaporating during discharge are at least partially emitter substances that reduce the work function at the cathode, that is, efficient operation of the cathode is increased compared to prior art flashbulbs. In the present invention the emitter substances evaporated from the hard glass are deposited on the cathode after discharge. In the flashbulb of the present invention, the easily volatized components of the hard glass deposit on the cathode without resulting in a reduced energy density, that is, without substantially reducing the electrical to radiant energy conversion of the flashbulb. An enhancement of the energy density is even possible.

BRIEF DESCRIPTION OF THE DRAWING

The features of the present invention which are believed to be novel, are set forth with particularity in the appended claims. The invention, together with further objects and advantages, may best be understood by reference to the following description taken in conjunction with the accompanying drawing, in which:

The single FIGURE is a cross-sectional view of a flashbulb of the present invention.

DESCRIPTION OF THE PREFERRED EMBODIMENT

The FIGURE depicts a flashbulb having a glass bulb 1 of hard glass at whose ends an anode 2 and a cathode 3 are fused into the glass bulb 1 in a gas-tight manner. The interior 4 of the flashbulb is filled with a Xenon gas. The cathode 3 is connected to a cathode member 5 and the anode 2 is connected to an anode member 6.

The following is a comparison of the materials used in the hard glass of the glass member 1 of the present invention to the materials used in prior art flashbulbs:

$Na_2O$ and $K_2O$ in prior art flashbulbs is replaced by $Rb_2O$, or $Cs_2O$, in the present invention;

CaO in prior art flashbulbs is replaced by SrO, or BaO, in the present invention; and $Al_2O_3$ in prior art flashbulbs is replaced by Sc, Y or La oxides in the present invention.

Tests have shown that hard glasses of this type having up to 50 percent of $Cs_2O$, BaO and LaO by weight yield a doubling of the energy density from about 0.5 Wattsec per $mm^3$ to about 1.0 Wattsec per $mm^3$ because these emitter substances condense on the cathode member 5 and reduce the work function of the cathode member 5. Glass containing $Rb_2O$ increases the useful life of the flashbulb, and glass containing $Cs_2O$ provides an even longer useful life of the flashbulb for full performance capability. The materials $Rb_2O$ and $Cs_2O$ deposit on the cathode as emitter substances.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. Flashbulb having two electrodes, one of the electrodes being a cathode member, fused gas-tight in a glass bulb of hard glass, comprising the composition of the hard glass selected such that the components thereof evaporating during discharge of the flashbulb are at least partially emitter substances that reduce the work function of the cathode member.

2. The flashbulb according to claim 1, wherein the hard glass contains at least $Cs_2O$ instead of $Na_2O$ and instead of $K_2O$.

3. The flashbulb according to claim 1, wherein the hard glass contains at least SrO instead of CaO.

4. The flashbulb according to claim 1, wherein the hard glass contains at least BaO instead of CaO.

5. The flashbulb according to claim 1, wherein the hard glass contains at least Sc instead of $Al_2O_3$.

6. The flashbulb according to claim 1, wherein the hard glass contains at least Y instead of $Al_2O_3$.

7. The flashbulb according to claim 1, wherein the hard glass contains at least La oxides instead of $Al_2O_3$.

8. The flashbulb according to claim 1, wherein the hard glass contains at least $Rb_2O$ instead of $Na_2O$ and instead of $K_2O$.

9. Flashbulb having two electrodes fused gas-tight in a glass bulb of hard glass, comprising the hard glass containing at least one of the materials from the group of materials containing $Rb_2O$, $Cs_2O$, SrO, BaO, Sc, Y or La oxides instead of any of the materials from the group of materials containing $Na_2O$, $K_2O$, CaO or $Al_2O_3$.

10. A flashbulb comprising:

a glass bulb composed of a hard glass;

at least two electrodes, one of the electrodes being a cathode member, fused gas-tight in the hard glass of the glass bulb; and the hard glass containing at least one material such that components of the hard glass including the material evaporating during discharge of the flashbulb are at least emitter substances that reduce the work function at the cathode member.

11. The flashbulb according to claim 10, wherein the hard glass contains at least $Cs_2O$ instead of $Na_2O$ and instead of $K_2O$.

12. The flashbulb according to claim 10, wherein the hard glass contains at least SrO instead of CaO.

13. The flashbulb according to claim 10, wherein the hard glass contains at least BaO instead of CaO.

14. The flashbulb according to claim 10, wherein the hard glass contains at least Sc instead of $Al_2O_3$.

15. The flashbulb according to claim 10, wherein the hard glass contains at least Y instead of $Al_2O_3$.

16. The flashbulb according to claim 10, wherein the hard glass contains at least La oxides instead of $Al_2O_3$.

17. The flashbulb according to claim 10, wherein the hard glass contains at least $Rb_2O$ instead of $Na_2O$ and instead of $K_2O$.

* * * * *